United States Patent [19]

Cramer et al.

[11] Patent Number: 4,839,077

[45] Date of Patent: Jun. 13, 1989

[54] THICKENED BLEACH COMPOSITION

[75] Inventors: Randall J. Cramer, Ridgecrest; William L. Smith, Pleasanton, both of Calif.

[73] Assignee: The Clorox Company, Oakland, Calif.

[21] Appl. No.: 173,000

[22] Filed: Mar. 23, 1988

Related U.S. Application Data

[63] Continuation-in-part of Ser. No. 894,234, Aug. 7, 1986, abandoned.

[51] Int. Cl.[4] ..... C11D 1/29; C11D 3/37; C11D 3/395

[52] U.S. Cl. ..... 252/98; 134/42; 252/95; 252/96; 252/99; 252/102; 252/187.24; 252/187.25; 252/187.26; 252/187.27; 252/187.28; 252/187.33

[58] Field of Search ..... 252/95, 98, 99, 102, 252/DIG. 2, DIG. 14, 187.24, 187.25, 187.26, 187.27, 187.28, 187.33; 134/42

[56] References Cited

U.S. PATENT DOCUMENTS 3,956,165 5/1976 Hansen et al. ..... 252/187.28
4,758,377 7/1988 Iding et al. ..... 252/556

*Primary Examiner*—Prince E. Willis
*Attorney, Agent, or Firm*—Michael J. Mazza; Joel J. Hayashida; Stephen Westbrook

[57] ABSTRACT

A thickened aqueous bleaching cleanser has a viscosity of at least 100 centipoise, provides a cleaning-effective residence time on non-horizontal surfaces, and maintains viscosity and bleach stability over a typical shelf life. In one embodiment the cleanser comprises a source of a halogen bleach, a copolymer thickener including a hydrophobic comonomer and a hydrophilic comonomer, and a mixed surfactant system including an uncharged surfactant and an anionic surfactant.

23 Claims, 6 Drawing Sheets

THICKENED BLEACH COMPOSITION

CROSS REFERENCE TO RELATED APPLICATIONS

This application is a Continuation-in-Part of Ser. No. 06/894,234, filed 8/7/86, abandoned.

BACKGROUND OF THE INVENTION

1. Field of The Invention:

The present invention relates to thickened aqueous cleaning compositions and in particular to a bleach-containing aqueous cleaning composition having a polymer/surfactant thickening system.

2. Description of the Prior Art:

Much prior art has addressed attempts to develop a thickened bleach cleanser, and advantages associated therewith are well documented in the art. The efficacy of cleaning compositions applied to non-horizontal surfaces is greatly improved by formulations which are highly viscous, increasing the residence time of the cleanser. Splashing during application and use is minimized, and consumer preference for a thick product is well documented. Numerous approaches to thickening a cleaning composition are known and include increasing the concentration of dissolved components, adding suspended solids, modifying characteristics of the dissolved components to create liquid crystal or gel phases, or by adding polymeric organic thickening agents. As used herein, "polymer" means a macromolecule made up of a plurality of chemical subunits (monomers). The monomers may be identical or chemically similar, or may be of several different types. Unless a more specific term is used, "polymer" will be taken to include hetero- and homopolymers, and random, alternating, block and graft copolymers. "Copolymer" will be used to specifically refer to those macromolecules made from two different repeating chemical monomers.

For various reasons, the prior art thickened compositions are not commercially viable. In many instances, thickening is insufficient to provide the desired residence time on non-horizontal surfaces. Adding components, and/or modifying characteristics of dissolved components often creates additional problems with the composition, such as syneresis, which require adding further components in an attempt to correct these problems. A drawback that has hampered prior art polymer thickened hypochlorite bleaching compositions is the tendency of the hypochlorite to oxidize the polymer, reducing or destroying its thickening capability. Prior art thickened bleach products generally exhibit phase instability at elevated (100° F.) and/or low (35° F.) storage temperatures. Further difficulties exist with clay type inorganic polymeric thickening agents in that these tend to exhibit either false-bodied or thixotropic rheologies, which, at high viscosities, can result in a tendency to set up or harden. Many of the compositions employing polymeric thickeners require relatively high levels of costly polymers. Many polymers used to thicken compositions are ineffective in high ionic strength compositions, thus are not suitable for use with bleach. Other hypochlorite compositions of the prior art are thickened with surfactants and may exhibit hypochlorite stability problems. Surfactant thickening systems also are not cost effective when used at the levels necessary to obtain desired product viscosity values.

Polymer-thickened hypochlorites are disclosed or described in several references. U.S. Pat. No. 4,011,172 issued to Marsan et al discloses clay thickened hypochlorite and suggests that polyacrylamides may also be suitable. Briggs, U.S. Pat. No. 3,663,442 discloses bleach including a styrene/acrylic acid polymer. The polymer is formulated as an insoluble particulate for opacification rather than thickening. Rupe et al, U.S. Pat. No. 4,116,851 shows a clay thickened hypochlorite bleach which could include polymeric thickening agents such as polystyrene, polypropylene, polyethylene or copolymers of styrene with e.g., acrylate, maleate or vinyl acetate. Such polymers are disclosed in particulate form, however, and apparently thicken only in conjunction with the inorganic clays. U.S. Pat. No. 4,438,016 issued to Kiewert et al discloses a hypochlorite cleanser containing amine oxides and paraffin sulfonates, and thickened by calcium aluminum silicates and optionally by acrylate or methacrylate copolymers. Zimmerer et al, U.S. Pat. No. 3,393,153 shows non-thickened hypochlorite bleach compositions which stably suspend optical brighteners aided by various insoluble polymers. Sabatelli, U.S. Pat. No. 4,147,650 shows a hypochlorite solution thickened with a combination of metasilicates and polyacrylate or polymethacrylate having a high average molecular weight, as typical of the prior art. Hynam et al, U.S. Pat. No. 3,684,722 discloses a thickened bleaching composition of amine oxides or betaines, an alkali-metal soap, an alkali metal hypochlorite and, optionally, caustic. Hynam et al mentions that polymers such as polyacrylates were tested for their ability to thicken the hypochlorite but no lasting thickening was achieved. French Pat. No. 78 23943 describes a non-surfactant, polymeric thickened hypochlorite composition. This patent illustrates the ineffectiveness of polymer thickeners of the art, as high levels of polymers such as polyacrylate (25% or more) are required to attain a moderate, one hundred centipoise (cP) thickening. Polyacrylates are generally shown in the art cited above to be unstable in hypochlorite solutions. Other references, such as Joy, U.S. Pat. No. 4,229,313 disclose surfactant thickened bleach compositions.

None of the prior art has successfully addressed the problem of developing a pourable, highly thickened, bleaching cleanser. The prior art is further deficient in teaching a bleach-stable cleanser capable of relatively high viscosity values, on the order of 300 cP and higher, and achieving such values with low levels of a polymeric/surfactant thickening system utilizing a relatively low molecular weight polymer.

SUMMARY OF THE PRESENT INVENTION

It is therefore an object of the present invention to provide an aqueous bleaching cleanser having a viscosity sufficient to provide cleaning-effective residence time on non-horizontal surfaces.

It is another object of the present invention to provide a thickened bleaching cleanser which is stable during normal storage, and at elevated temperatures.

It is another object of the present invention to provide a pourable thickened bleaching cleanser which will not harden, set up, or exhibit syneresis.

Briefly, one embodiment of the present invention comprises a thickened stable household bleaching composition comprising:

(a) an active halogen compound, i.e., a bleach;

(b) a thickener, compatible with the active halogen compound and comprising an ethylene acrylic acid copolymer; and (c) a mixed surfactant system comprising an N-acyl sarcosinate surfactant, and an alkyl dimethyl amine oxide surfactant wherein the acyl and alkyl groups are eight to eighteen carbons in length.

The thickened cleanser of the present invention exhibits a viscosity sufficient to provide for cleaning effective residence time when applied to non-horizontal surfaces, preferably above about 100 centipoise (cP), and may be formulated to have a viscosity on the order of 1000–2000 cP. While the mixed surfactant system alone will yield a relatively high composition viscosity, the highest viscosity levels can be reached only through the surfactant system in combination with the polymer. Further, when enough surfactant is present to yield a minimal viscosity, above about 20–50 cP, and is enough to solubilize the polymer, viscosity can be synergistically increased by low level addition of polymer, up to its solubility limit. Low levels of polymer in combination with sufficient surfactant to solubilize the polymer not only provides a synergistic viscosity increase, but because the polymer/surfactant system achieves high viscosities with relatively low concentrations, hypochlorite stability is improved. As an added benefit, the thickened composition can be formulated to exhibit a Newtonian rheology, resulting in a flowable, pourable product which does not require nozzle-type packaging. Because clay thickening agents are not used, the composition does not exhibit false-bodied or thixotropic rheologies which may set up and harden and/or exhibit syneresis.

It is an advantage of the present invention that highly viscous compositions can be obtained using low levels of polymer and surfactant.

It is another advantage of the present invention that the composition is phase and hypochlorite stable over a typical storage shelf life.

It is another advantage of the present invention that total organic content of the bleach composition is kept to a minimum.

It is yet another advantage of the present invention that the composition can be formulated to exhibit a Newtonian rheology, and does not set up or harden, or exhibit syneresis.

It is another advantage of the present invention that the viscous solution may be obtained of relatively low cost.

IN THE DRAWINGS

FIGS. 1*a*–1*c* are graphs showing initial viscosity profiles, in cP, for a first formulation of the composition of the present invention with 4.3% hypochlorite;

FIGS. 2*a*–2*c* are graphs showing viscosities of the composition of FIGS. 1*a*–1*c* after 4 weeks storage at room temperature (RT);

FIGS. 3*a*–3*c* are graphs showing viscosities of the composition of FIGS. 1*a*–1*c* after 4 weeks storage at 100° F.;

FIGS. 4*a*–4*c* are graphs showing initial viscosity profiles, in cP, for a second formulation of the composition of the present invention with 2.5% hypochlorite;

FIGS. 5*a*–5*c* are graphs showing viscosities of the composition of FIGS. 4*a*–4*c* after 4 weeks storage at room temperature (RT); and FIGS. 6*a*–6*c* are graphs showing viscosities of the composition of FIGS. 4*a*–4*c* after 4 weeks storage at 100° F.

DETAILED DESCRIPTION OF THE PREFERRED EMBODIMENT

Figure 1A:
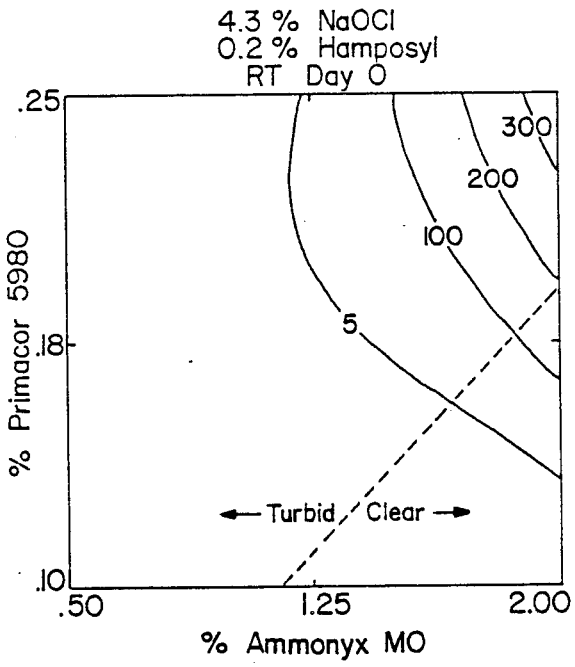

In one embodiment of the present invention, the cleanser comprises, in aqueous solution, the essential components of (a) a bleach;

(b) a polymeric thickening agent; and (c) a mixed surfactant system, all of which are hereinafter described in detail.

BLEACH

A source of bleach is selected from various halogen bleaches. Examples of such bleaches include those selected from the group consisting essentially of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounnds include sodium, potassium, lithium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo- and dichloro dimethylhydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.2% to about 15%, more preferably about 0.2% to 10%, and most preferably about 2.0% to 6.0%. This bleach is an oxidizing cleaning agent which is very effective against oxidizable stains.

POLYMER

The preferred polymers suitable for use in the composition of the present invention are copolymers having a hydrophobic comonomer and a hydrophilic comonomer. By selection of comonomers, a copolymer of the correct solubility and charge balance is obtained, and is the key to the success of the composition of the present invention. An additional polymer parameter which influences solubility, and hence viscosity, is the molecular weight of the polymer. Many polymeric thickeners of the prior art rely on electrostatic repulsions for thickening. In embodiments of the present invention where sodium hypochlorite is used as the bleach source, the composition possesses a high ionic strength from the sodium hypochlorite together with an approximately equimolar amount of sodium chloride formed during manufacturing of the bleach. Such high ionic strength lessens electrostatic repulsions, consequently prior art polymeric thickening in such compositions is inefficient. The composition of the present invention incorporates a copolymer having an uncharged comonomer and a charged comonomer resulting in a copolymer which is itself distinct from polymers of the art. The charge comonomer will impart a degree of hydrophilic character to the polymer while the uncharged comonomer will impart some hydrophobicity to the polymer. Such copolymer functions well in high ionic strength media such as bleach compositions and in fact some ionic strength is required for the thickening-effecting association of the copolymer with the surfactant system. The ionic strengths of the present composition can range from about 0.5 to 5.0 molal, with the preferred range from about 1.5 to 3.0 molal, and most preferred is 2.0 to 2.5 molal. Ionic strength is calculated by multiplying each species' molality by the square of its ionic charge, adding these products, and dividing by the number of species. In further contravention of the art, the copolymer is selected to have a lesser net charge and a lower molecular weight than polymers typically employed as thickeners. It would ordinarily be expected that decreasing the charge of the polymer would decrease the viscosity of the composition, owing to the electrostatic nature of polymeric thickening of the art. The composition of the polymer of the present invention, however, uncharacteristically results in a significant increase in solution viscosity despite the lesser net charge of the polymer. Surprisingly, thickening is accomplished using the relatively low molecular weight polymers of the present invention. This is believed to be due to the hydrophobic-hydrophilic balance imparted to the polymer by the ratio of charged comonomers to uncharged comonomers. Because the polymer is selected, based in part upon the ratio of charged-groups to uncharged groups and in part upon overall molecular weight, it is believed that the solubility of the polymer in media possessing some ionic strength is decreased, thus the composition exhibits an increase in viscosity by a relatively large amount. This is thought to be due to the predomimance of hydrophobic rather than electrostatic forces. A preferred copolymer thickener has an acid number of between about 80–400 mg KOH/g polymer. Typically such a preferred copolymer will include about 20 to 75 mole percent uncharged comonomer and about 80 to 25 mole percent uncharged comonomer. A more preferred copolymer thickener has an acid number between about 120 and 250 mg KOH/g polymer, and typically comprises about 30 to 50 mole percent charged comonomer and about 70 to 50 mole percent uncharged comonomer. The preferred polymer also has a weight average molecular weight of between about one thousand and one hundred thousand g/mole, and more preferably between about three thousand and thirty thousand g/mole. As used herein, the acid number of a polymer refers to the polymer in its unneutralized, acid form. The acid number is the milligrams of potassium hydroxide needed to neutralize one gram of polymer, and may be converted to milliequivalents of acid groups per gram of polymer by dividing by 56.10 (the molecular weight of potassium hydroxide). This number may then be multiplied by the equivalent weight of the charged comonomer and divided by ten to yield weight percent of charged comonomer. It is noted that the acid number is the preferred quantity to describe the polymers of the present invention because it specifies the correct proportion of charged groups regardless of the molecular weight of the comonomers and number of charged groups per molecule of charged comonomer.

The most preferred polymer is a copolymer of ethylene and acrylic acid, with the acrylic acid present in an amount ranging from 20 to 75 mole percent, and most preferably between 30 and 50 mole percent, the polymer preferably having an acid number of about 80–400 mg KOH/g polymer, most preferably about 120–250 mg KOH/g polymer. The acrylic acid content is selected to be high enough so that the polymer can be solubilized by the surfactant system, yet not so high that no thickening results. Depending on the types and concentration of surfactants, and on the composition ionic strength, the acrylic acid content may be reduced to about 20 to 30 mole percent. If other hydrophilic comonomers are used instead of acrylic acid, the percentage thereof may vary depending on the resulting solubility imparted to the polymer. Similarly, if comonomers more hydrophobic than ethylene are used, such as propylene, the acrylic acid content may be increased above about 40 mole percent to impart sufficient solubility to the copolymer. Generally, increasing the amount of surfactant increases the solubility of the polymer, while increasing ionic strength decreases polymer solubility. The ideal polymer composition will accordingly depend on surfactant type and concentration, and on the ionic strength of the composition. Alternatively, types and concentrations of surfactants can be varied, as can the ionic strength of the composition, to increase the effectiveness of a given polymer. The copolymer must be neutralized with a base (such as NaOH) in order to achieve the thickening-effective association with the surfactant system. The neutralization converts some of the carboxylic acid groups to carboxylate groups, resulting in an ionomer with a negative charge, which is necessary for effective solubilization by the surfactant system, and so that no neutralization of the hypochlorite by the polymer occurs. The copolymer thickener, when combined with the surfactant system, is completely solubilized so that a solution results, which is substantially free of undissolved solids.

An example of a most preferred ethylene/acrylic acid polymer is manufactured by Dow Chemical Company and sold under the trademark Primacor, and more specifically, Primacor 5980. Primacor 5980 has a weight average molecular weight of about eighteen thousand, a number average molecular weight of about seven thousand, a melt index of 300, a crystalline melting temperature (Tm) of 85° C., a density of about 0.960 g/cm$^3$, and an acid number of 155 mg KOH/g. Dow Chemical's Primacor 5981, 5983, 5990 and 5991 will also function in the present invention. Number average molecular weights for these Primacors are as follow: 5981 is about eight thousand; 5983 is about seventy seven hundred; 5990 is about fifty nine hundred; and 5991 is about fifty four hundred. All have about 20% acrylic acid content.

While the ethylene-acrylic acid copolymer is most preferred, other charged monomers can be copolymerized with the ethylene to achieve satisfactory results within the scope of the invention. Such monomers include methacrylic acids, carboxylated or sulfonated styrene, ethylene sulfonic acid (which may be combined with higher molecular weight alkenes) alkene carboxylic acid, and maleic acid. Half-esters of dicarboxylic acids such as maleic acid are also suitable charged monomers, and preferably are made from alcohols with eight or less carbon atoms. In some cases, the ester half can act as the hydrophobic monomer and the acid half can act as the charged monomer, and the polymer thickener would be derived from a single molecule. Maleic acids and their esters could be used as monomers, but more commonly they would be formed after copolymerization of maleic anhydride. Mixtures of any of the foregoing may also be suitable. Further, other hydrophobic monomers may serve as well as ethylene. These include, for example, propylene, butadiene, and styrene. Esters can also serve as hydrophobic monomers. Methyl and ethyl esters of acrylic and methacrylic acids are preferred. Esters made from longer-chained alcohols should also work. Similarly, diesters of dicarboxylic acids such as maleic acid can also be used. The esters can be incorporated as monomers, or they can be made from acid or anhydride groups after polymerization. Mixtures of the foregoing may also be suitable. It is also within the scope of the present invention to employ a hydrophobic homopolymer having a weight-average molecular weight of between about one thousand and one hundred thousand, and having hydrophilic groups attached to the polymer chain, formed by subsequent chemical modification of the polymer, rather than by copolymerization. Such hydrophilic groups include, for example, carboxylates, sulfonates or sulfates. At least about 10% of the polymer should be so modified to result in the desired solubility parameters. Sulfonating polystyrene can result in the desired polymer, as can oxidizing microcrystalline waxes to obtain a carboxylated polyethylene.

SURFACTANT SYSTEM

A two-component surfactant system is utilized in the present invention and acts with the polymer to provide the unexpectedly high viscosity. The surfactant system comprises at least two different detergent active compounds, of which at least one must be soluble in aqueous hypochlorite solutions, and both of which should preferably be bleach-resistant. In the preferred embodiment, one such component of the surfactant system is an uncharged surfactant selected from the group consisting of amine oxides, betaines and mixtures thereof, and the other component is an anionic compound selected from the group consisting of acyl sarcosinates, alkyl taurides, alkylsulfates, sugar esters, alkyl or aryl ether sulfates and carboxylates, alkyl diphenyloxide sulfonates, soaps and mixtures thereof. For the purposes of the present invention, an uncharged surfactant is one with no overall net charge at the preferred alkaline pH range of the present invention, and includes, nonionic, amphoteric and zwitterionic surfactants. In the more preferred embodiment, the uncharged surfactant is an amine oxide and the anionic surfactant is an amidocarboxylate, and in the most preferred embodiment the uncharged surfactant is dimethyltetradecyl amine oxide and the anionic surfactant is an alkali metal lauroyl sarcosinate. Lauroyl sarcosinates are the most preferred anionic surfactants as they are resistant to oxidation by such materials as hypochlorite, hence are bleach-resistant, even at elevated temperatures. Specific examples of the surfactants of the most preferred embodiment include those sold under the trademarks Ammonyx MO (amine oxide) and Hamposyl L (sodium lauroyl sarcosinate). The former is manufactured and marketed by Onyx Chemical Company and the latter by WR Grace and Co.

The longest alkyl group ($R_1$) of the amine oxide generally can have eight to eighteen carbons in length; higher than this may create phase instability. Amine oxides having an $R_1$ less than eight carbons in length are generally too solubilizing so that no thickening results. The most preferred is the $C_{14}$ amine oxide, and in particular Onyx Chemical's Ammonyx MO. Other Onyx Ammonyx products suitable for use in the present composition, although not as preferred, are Ammonyx LO ($C_{12}$), Ammonyx MCO (a $C_{14}$–$C_{16}$ mixture), and Ammonyx CO. ($C_{16}$). Alkali metal lauroyl sarcosinates such as Hamposyl L are the preferred anionic surfactants as they are soluble in an aqueous bleach composition, and can act as a hydrotrope for other materials. The longer-chain Hamposyl M and Hamposyl S, also manufactured and marketed by WR Grace and Co. and comprised predominantly of myristoyl sarcosinate and stearoyl sarcosinate, respectively, will also give satisfactory results, and may improve thickening. A further example of an anionic surfactant which can be employed in the composition of the present invention is an alkyl diphenyloxide disulfonate, in particular a mixture of sodium mono- and didodecyldiphenyloxide disulfonates manufactured and marketed by the Dow Chemical Company under the trademark Dowfax 2A1. The alkyl group of Dowfax 2A1 is derived from a propylene tetramer. Other branched or linear, 6 to 18 carbon alkyl groups are also suitable. Of course, it is neither cost effective nor necessary to utilize monodisperse surfactants; commercially available polydisperse surfactants are completely suitable. Relatively low levels of the surfactants and polymer are needed to achieve the thickening of the present invention, i.e., approximately 100 cP and higher. Experimental results show that the relatively high viscosities can be achieved with a relatively low level of total organics. The addition of the polymeric thickening agent to the surfactant system provides several unexpected benefits. Surfactants alone are generally incapable of thickening bleach above 500 cP, and high concentrations are necessary to achieve a significant level of thickening. Similarly, polymers alone are generally incapable of producing highly viscous, pourable bleach solutions due to dispersion and solubility difficulties associated with the polymer. The surfactant system combined with the polymer of the present invention surprisingly yields significant increases in viscosity at relatively low total concentrations of surfactant plus polymer. While not entirely understood, it is believed that the surprisingly increased viscosity is due to an association between polymer and surfactant. Not only is thickening improved, but because the total concentration of organic components (surfactant and polymer) is lower, hypochlorite stability is improved for any given viscosity value. As long as surfactant is present in an amount sufficient to solubilize polymer, and to provide a minimal co-surfactant thickening, the addition of polymer will synergistically improve the composition viscosity. Determining proper levels of surfactant and the polymer is important to the invention. Surfactant must necessarily be present in an amount sufficient to solubilize the polymer. It has been found that the solubilizing-effective weight ratio of surfactant to polymer is about 5:1. It is believed that surfactant solubilization of polymer occurs via complex formation with the polymer, or by adsorption onto the polymer. Sufficient surfactant must be present also to attain a minimal viscosity, above about 20–50 cP, or the synergistic thickening effect of the polymer will not occur.

Table 1 illustrates the effect of varying amounts of polymer and surfactant on viscosity. Samples A and B do not exhibit a significant viscosity increase because it is believed that the total surfactant concentration is insufficient to attain the minimal viscosity needed to display the synergistic thickening in association with the polymer. It can be seen that samples C-H are highly viscous, have solubilizing amounts of surfactant, and show a viscosity ten to twenty times greater than the same composition excluding polymer.

TABLE 1

| | THICKENED BLEACH COMPOSITIONS (% ACTIVES) | | | | | | |
|---|---|---|---|---|---|---|---|
| Sample # | % Polymer | % Amine Oxide | % Hamp | % NaOCl | % NaOH | Viscosity (cP) | Viscosity (cP) (Without polymer) |
| A | 0.12 | 1.6 | 0.01 | 5.6 | 1.8 | 20 | N/A |
| B | 0.12 | 1.6 | 0.05 | 5.6 | 1.8 | 50 | N/A |
| C | 0.12 | 1.6 | 0.10 | 5.6 | 1.8 | 100 | 10 |
| D | 0.12 | 1.6 | 0.15 | 5.6 | 1.8 | 150 | N/A |
| E | 0.12 | 1.6 | 0.20 | 5.6 | 1.8 | 200 | 20 |
| F | 0.15 | 2.0 | 0.20 | 5.6 | 1.8 | 400 | 20 |
| G | 0.15 | 2.0 | 0.40 | 5.6 | 1.8 | 1000* | 150 |
| H | 0.18 | 2.0 | 1.00 | 5.6 | 1.8 | 2000* | N/A |

Polymer - Primacor 5980
Amine Oxide - Ammonyx MO
Hamp - Hamposyl L
Viscosity - measured at room temp (20° C.) using a Brookfield Viscometer with a No. 2 spindle (*measured with No. 3 spindle)

ELECTROLYTES/BUFFERS

Electrolytes and buffers may also be added to the composition of the present composition. Low levels of electrolytes such as NaCl function to provide ions in aqueous solution and have been shown to measurably improve solution viscosity. Sodium hypochlorite advantageously includes some sodium chloride formed during manufacturing. Sodium chloride may be added to alternative bleaches, or to sodium hypochlorite, as needed to increase ionic strength. Buffers, on the other hand, may act to maintain pH, and in this instance, an alkaline pH is favored for attaining viscosity and for maintaining hypochlorite stability to enhance bleach effectiveness over time. Some compounds will serve as both buffer and electrolyte. These particular buffers/electrolytes are generally the alkali metal salts of various inorganic acids, to wit the alkali metal phosphates, polyphosphates, pyrophosphates, triphosphates, tetraphosphates, silicates, metasilicates, polysilicates, carbonates, hydroxides, and mixtures of the same. Certain salts, e.g., alkaline earth phosphates, carbonates, hydroxides, etc., can function singly as buffers. If such compounds were used, they would be combined with at least one of the previous electrolytes/buffers mentioned to provide the appropriate pH adjustment. It may also be suitable to use as buffers such materials as aluminosilicates (zeolites), borates, aluminates and bleach-resistant organic materials, such as gluconates, succinates, maleates, and their alkali metal salts. These electrolyte/buffers function to keep the pH ranges of the inventive cleaners preferably about 7.0, more preferably at between about 11.0 to 14.0. The total amount of electrolyte/buffer including that inherently present with bleach plus any added, can vary from about 0.5% to 25%, preferably 1% to 15%, most preferably between about 5 to 10%. Maintenance of the pH within the range of about 11.0 to 14.0 is essential to ensure composition stability by minimizing chemical interactions between the bleach and surfactant/polymer system, and by minimizing decomposition of the hypochlorite. Composition performance is also aided in that soil and stain removal is more effective in this pH range.

Preferred in terms of its ability to provide free alkali and to aid in stabilizing the hypochlorite is caustic (sodium hydroxide). Caustic may be added in amounts ranging from about 0.25% to 4.0%, and preferred is a composition including about 0.25% to 2.0% caustic. Caustic percentage will generally be in the same range as surfactant percentage (up to about 1% surfactant) for optimum stability. Higher percentages of caustic may be justifiable from a stability standpoint, but not so from a toxicological standpoint.

OPTIONAL INGREDIENTS

The composition of the present invention can be formulated to include such components as fragrance, coloring agents, whiteners, solvents and builders, which enhance performance, stability or aesthetic appeal of the composition. From about 0.01% to about 0.5% of bleach-stable fragrance such as those commercially available from International Flavors and Fragrance, Inc. may be included in the composition and may even aid in thickening. Preferably the minimum amount of fragrance is added since in large amounts fragrance tends to produce phase and hypochlorite instability in the composition, and is costly. Bleach stable dyes and pigments may be included in small amounts. Ultramarine Blue (UMB) and copper phthalocyanines are examples of widely used bleach-stable pigments which may be incorporated in the composition of the present invention. Small amounts of organic solvents, which may be tertiary alcohols or saturated hydrocarbon solvents, can be added to aid in removing nonpolar, oily or fatty stains. Suitable builders which may be optionally included comprise carbonates, phosphates and pyrophosphates. Such builders function as is known in the art to reduce the concentration of free calcium or magnesium ions in the aqueous solution. Certain of the previously mentioned buffer materials, e.g. carbonates, phosphates and pyrophosphates also function as builders. Typical of builders which do not also function as buffers include sodium and potassium tripolyphosphate and potassium hexametaphosphate.

In the preferred embodiment the composition of the present invention is formulated with about 0.2% to 15% bleach, 0.1% to 1.0% polymer, 0.5% to 3.0% amine oxide, and 0.1% to 2.0% sarcosinate. More preferred is 0.2% to 10% bleach, 0.1% to 0.3% polymer, 0.75% to 2.0% amine oxide and 0.1% to 1.5% sarcosinate. Most preferred, for both overall viscosity and bleach stability is about 2.0% to 6.0% bleach, 0.1% to 0.2% polymer, 1.0%–2.0% amine oxide and 0.1% to 1.0% sarcosinate. At the lower hypochlorite levels, the composition viscosity is further enhanced by the addition of about 0.5% to 5% of an electrolyte such as sodium chloride. This is particularly true when the viscosity is in the lower range.

EXPERIMENTAL

Figure 1B:
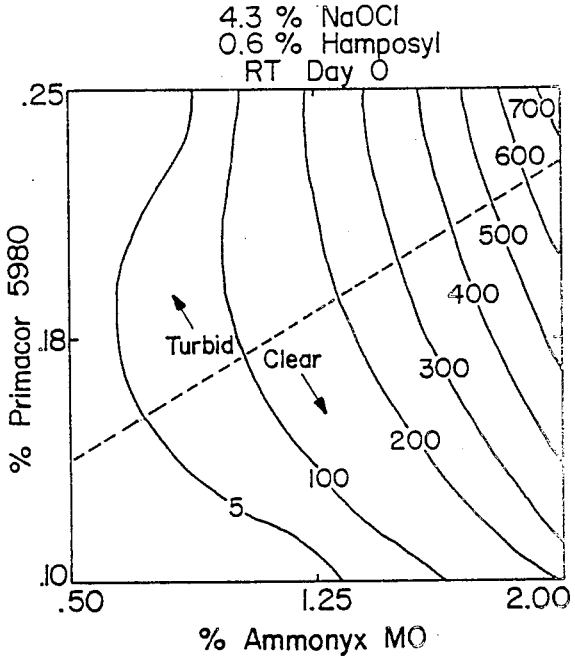
Figure 1C:
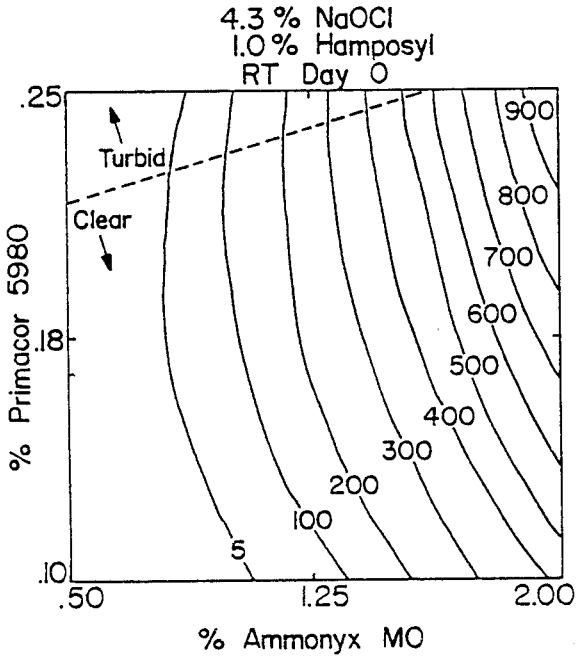
Figure 2A:
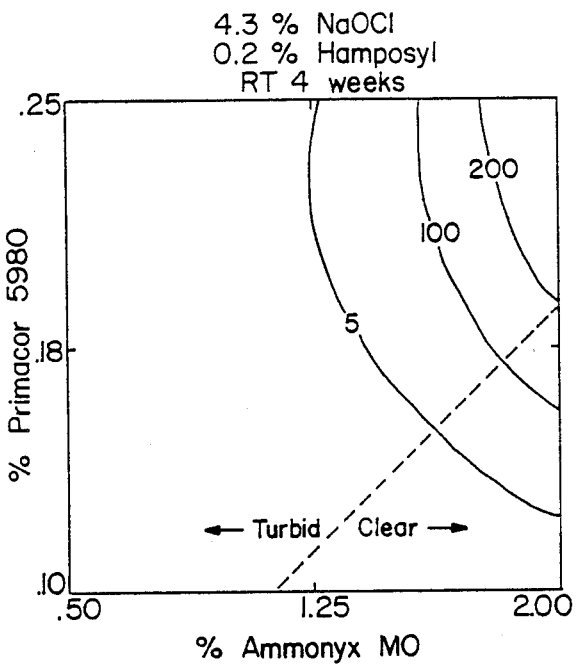
Figure 2B:
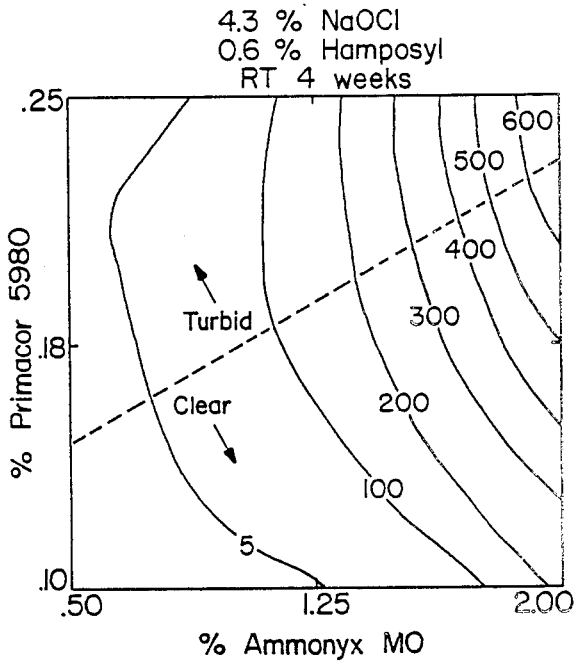
Figure 2C:
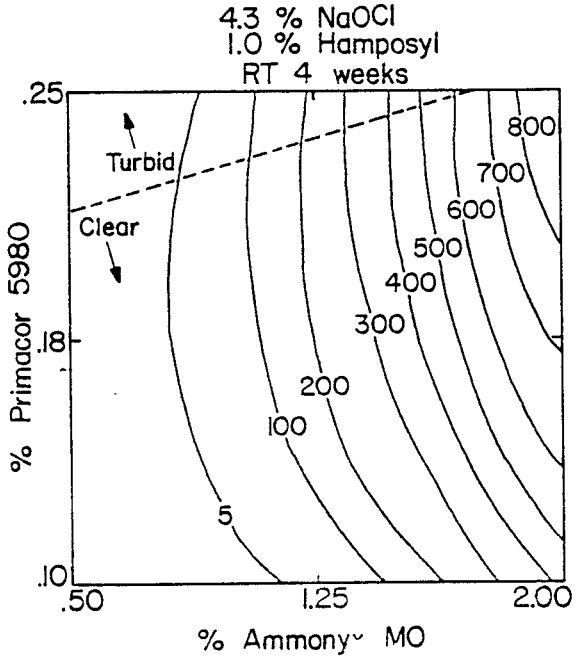
Figure 3A:
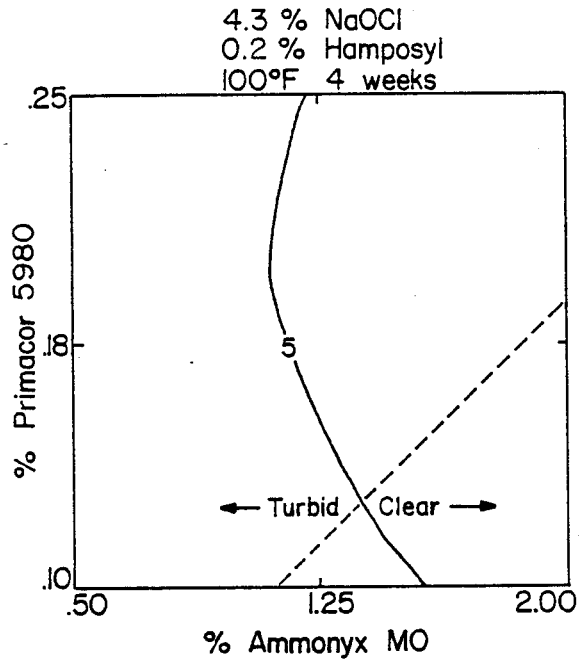
Figure 3B:
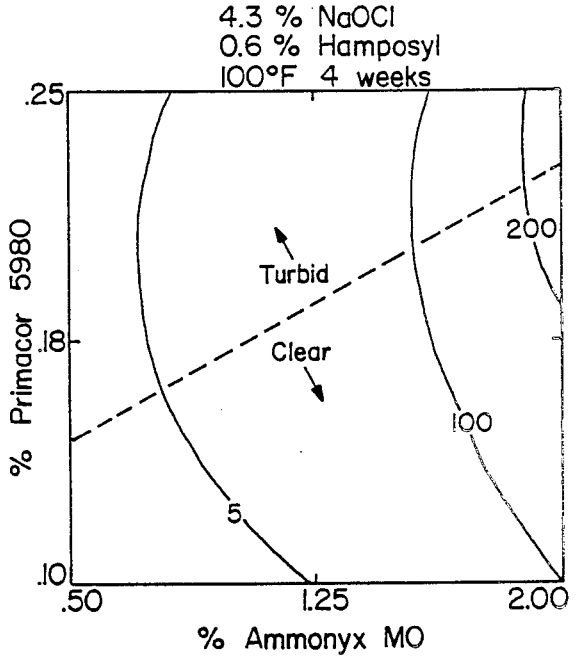
Figure 3C:
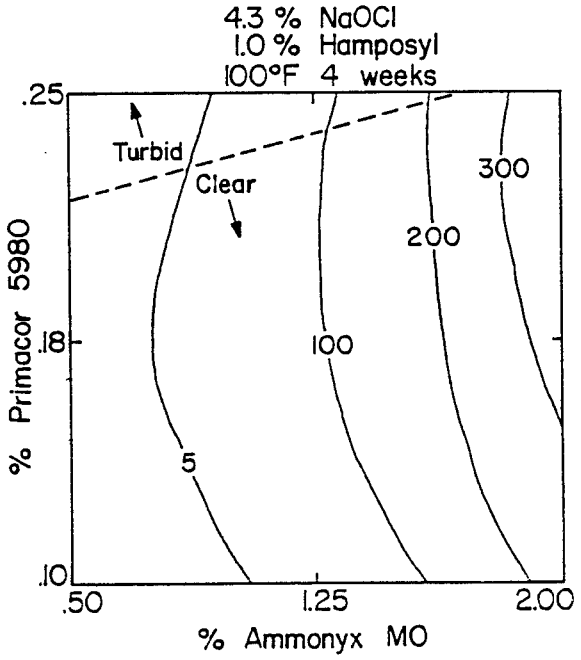
Figure 4A:
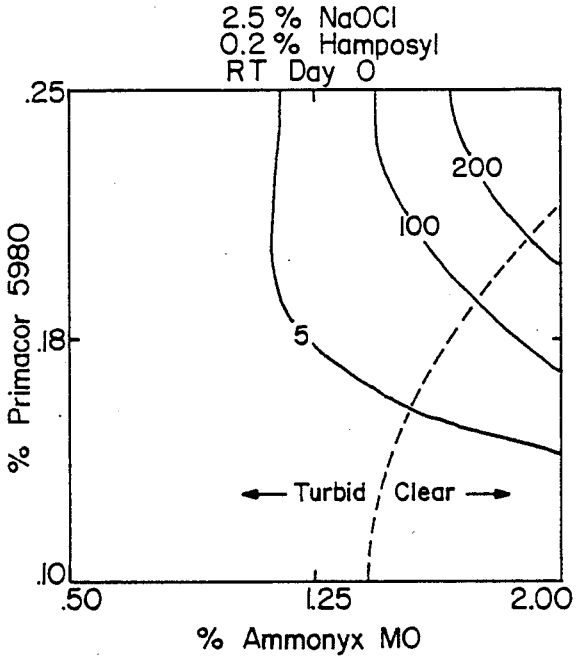
Figure 4B:
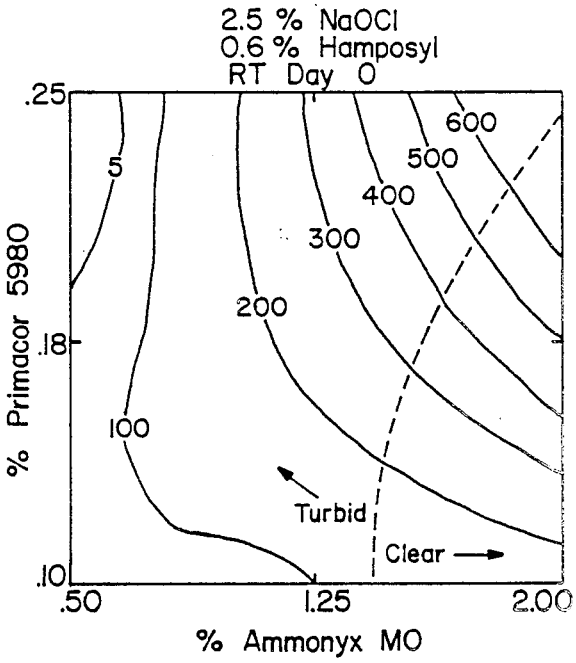
Figure 4C:
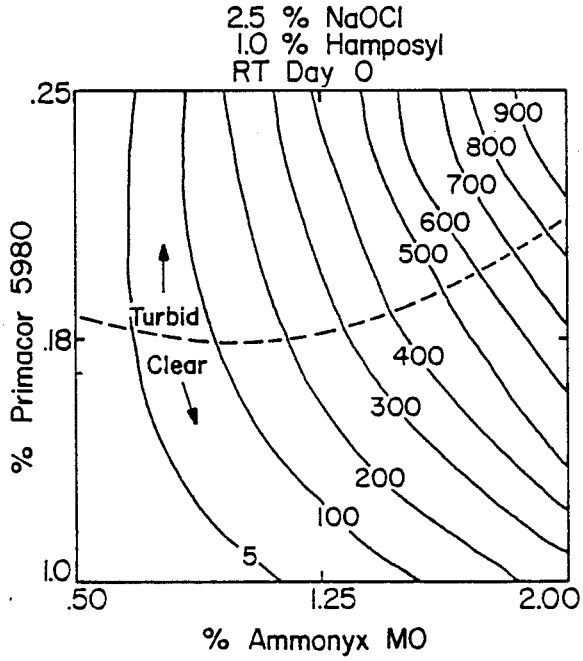
Figure 5A:
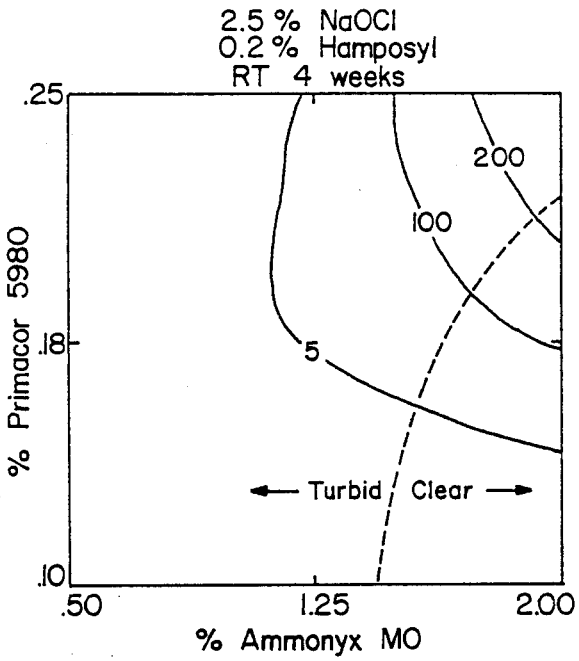
Figure 5B:
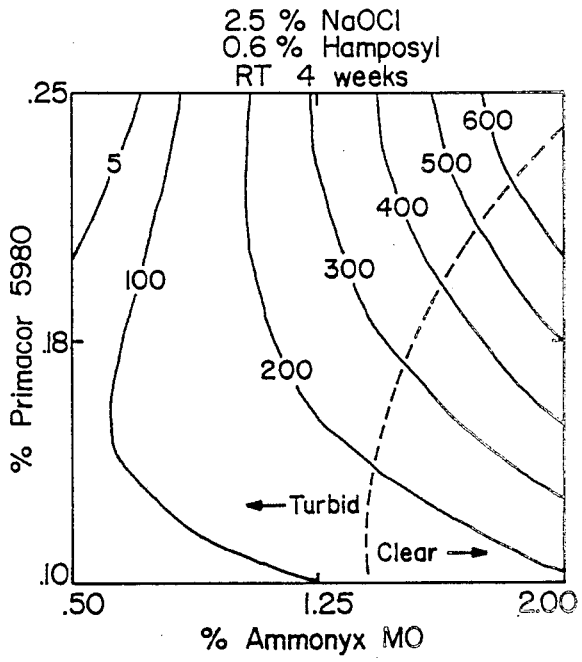
Figure 5C:
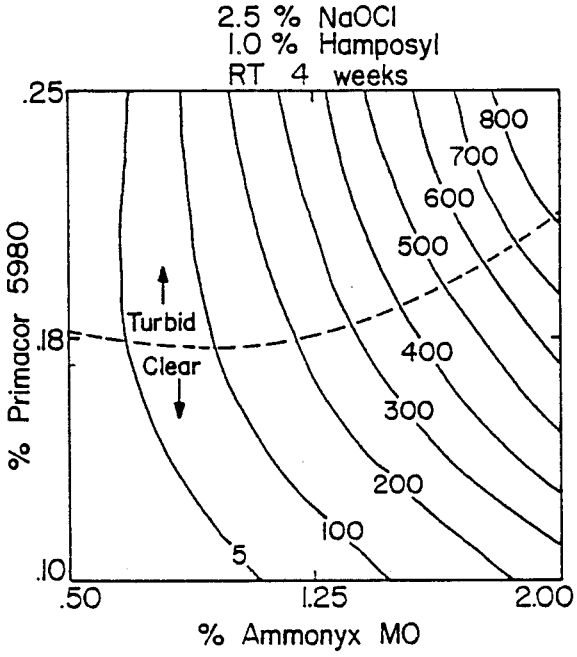
Figure 6A:
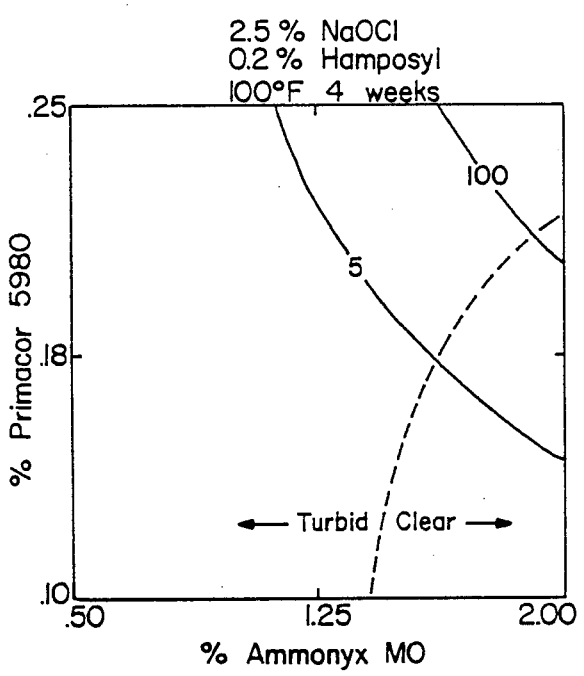
Figure 6B:
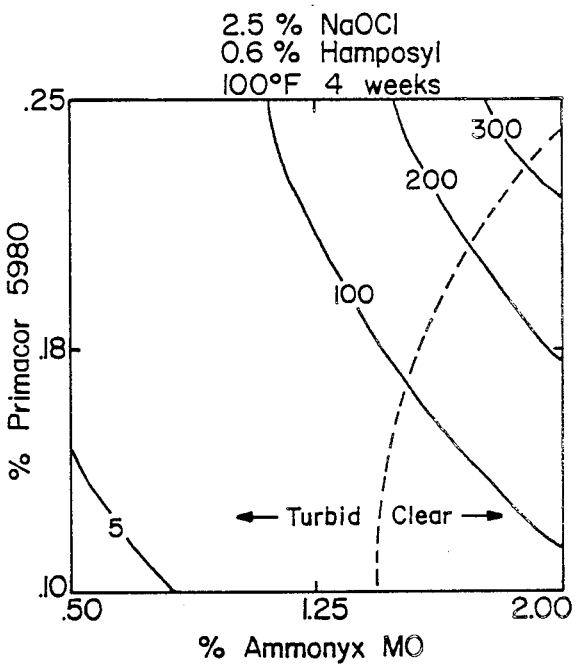
Figure 6C:
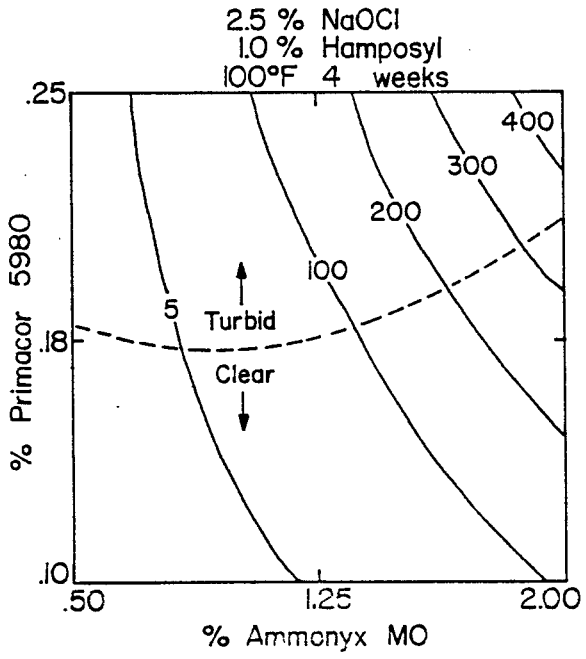

FIGS. 1–6 show viscosity profiles for various compositions of the present invention. In all Figs., viscosity measurements are given in cP and were taken using a Brookfield Viscometer with a number two spindle. FIGS. 1-3 are 4.3% NaOCl compositions, with FIGS. 1(*a-c*) showing initial viscosity measurements at room temperature (RT), FIGS. 2(*a-c*) showing viscosity after four weeks at RT and FIGS. 3(*a-c*) after four weeks at 100° F. FIGS. 4-6 are 2.5% NaOCl compositions, with FIGS. 4(*a-c*) illustrating initial RT viscosities, FIGS. 5(*a-c*) after four weeks at RT, and FIGS. 6(*a-c*) after four weeks at 100° F. Certain compositions were found to have been turbid upon preparation and eventually phase separated. Those formulations remaining clear upon preparation remained phase stable. A phase boundry is depicted by the broken line in FIGS. 1-6 and indicates phase-stable regions of operability. The Primacor polymers, including Primacor 5980, 5981, 5983, 5990 and 5991 are self-emulsifying polymers, i.e., a solution of the polymer may be prepared simply by neutralizing the free carboxylic acid with base under reflux conditions. A 10% Primacor dispersion may be made by combining 10.0 g of Primacor copolymer, 1.2 g of NaOH and 88.8 g of water. The neutralized polymer is soluble in water, resulting in a clear and transparent dispersion. This dispersion is used to formulate the cleaning composition of the present invention. While Primacor 5980 is generally insoluble in hypochlorite solutions, the addition of a surfactant increases solubility enough to avoid any precipitation. Polymer solubilization occurs at surfactant:polymer weight ratios of between about 5:1 to about 30:1, and mole ratios of amine oxide:carboxylate functionality of between about 7:1 to 120:1. Experimentation has shown these relationships to be consistent over a broad range of polymer concentrations, indicating that solubility is not a function of polymer concentration, but is dependent upon the ratio of polymer to surfactant.

Tables 2 and 3 illustrate polymer solubility in terms of surfactant:polymer weight ratios and amine oxide:carboxylate functionality, respectively. The tables show the ratios wherein the solution remained clear, or became turbid.

TABLE 2

Weight Ratio Primacor 5980 Solubilization by Ammonyx MO in Clorox Liquid bleach*

| % Primacor 5980 | % Ammonyx MO | Wt. Ratio (S/P) | Result |
|---|---|---|---|
| 0.05 | 0.2 | 4 | turbid |
| 0.05 | 0.3 | 6 | clear |
| 0.10 | 0.2 | 2 | turbid |
| 0.10 | 0.3 | 3 | turbid |
| 0.10 | 0.4 | 4 | turbid |
| 0.10 | 0.6 | 6 | clear |
| 0.20 | 0.8 | 4 | turbid |
| 0.20 | 1.0 | 5 | clear |

TABLE 3

Mole Ratio Primacor 5980 (Ionic Groups) Solubilization by Ammonyx MO in Clorox Liquid bleach*

| mmoles carboxylate | mmoles amine oxide | mole ratio | Result |
|---|---|---|---|
| 0.14 | 0.78 | 5.6 | turbid |
| 0.14 | 1.16 | 8.3 | clear |
| 0.28 | 0.78 | 2.8 | turbid |
| 0.28 | 1.16 | 4.1 | turbid |
| 0.28 | 1.56 | 5.6 | turbid |
| 0.28 | 2.33 | 8.3 | clear |
| 0.55 | 3.11 | 5.6 | turbid |
| 0.55 | 3.89 | 7.1 | clear |

*5.6% hypochlorite

Table 4 shows hypochlorite stability for various compositions of the present invention. The compositions of Table 4 were formulated to have an initial hypochlorite concentration of 4.3%. Hypochlorite concentration was measured after four weeks at room temperature (RT) and after four weeks at an elevated (100° F.) temperature. It was found that the bleach half life was good for all compositions but those with the highest levels of polymer, i.e, one percent or more. As shown by the graphs of FIGS. 1-6, such high polymer concentrations are not even necessary to attain high viscosities.

TABLE 4

Hypochlorite Stability

| % Primacor(1) | % MO(2) | % Hamp(3) | % NaOH | % $NaOCl_o$ | % NaOCl RT 4 wk | % NaOCl 100F 4 wk |
|---|---|---|---|---|---|---|
| | | | Control | | | |
| 0.0 | 0.0 | 0.0 | 1.0 | 4.3 | 4.1 | 3.8 |
| | | | Primacor(1) | | | |
| .25 | 0.0 | 0.0 | 1.0 | 4.3 | 3.8 | 3.5 |
| .50 | 0.0 | 0.0 | 1.0 | 4.3 | 3.6 | 3.0 |
| 1.00 | 0.0 | 0.0 | 1.0 | 4.3 | 3.5 | 3.0 |
| | | | Ammonyx MO | | | |
| 0.0 | 1.0 | 0.0 | 1.0 | 4.3 | 4.1 | 3.3 |
| | | | Ammonyx MO Plus Hamposyl L | | | |
| 0.0 | 1.0 | 0.5 | 1.0 | 4.3 | 3.9 | 3.3 |
| 0.0 | 1.0 | 1.0 | 1.0 | 4.3 | 3.9 | 3.3 |
| | | | Primacor(1) Plus Ammonyx MO | | | |
| 0.25 | 0.75 | 0.0 | 1.0 | 4.3 | 3.6 | 3.1 |
| 0.25 | 1.25 | 0.0 | 1.0 | 4.3 | 3.6 | 3.2 |
| 0.25 | 1.50 | 0.0 | 1.0 | 4.3 | 3.7 | 3.1 |
| | | | General Composition | | | |
| 0.25 | 1.2 | 0.5 | 1.0 | 4.3 | 4.0 | 3.0 |
| 0.30 | 1.2 | 0.5 | 1.0 | 4.3 | 3.9 | 3.3 |

(1)Primacor 5980
(2)Ammonyx MO
(3)Hamposyl L

Tables 5 and 6 are viscosity and hypochlorite stability tables for various compositions of the present invention, with initial hypochlorite concentrations set at 4.3% and 2.5% respectively. The composition of Table 6 (2.5% hypochlorite) includes added sodium chloride to achieve an ionic strength comparable to the composition of Table 5 (4.3% hypochlorite). Weight percentages of components in the numbered samples of Table 5 correspond to those of Table 6, with the exception of the added sodium chloride to the Table 6 samples. Viscosity and hypochlorite concentrations were evaluated after four weeks of storage at room temperature and at elevated (100° F.) temperature.

Room temperature (RT) stability of both viscosity and hypochlorite was good for all formulations. Elevated temperature hypochlorite stability was also good for all compositions. The higher viscosity formulations exhibited decreases in viscosity, at elevated temperatures, after 4 weeks, however all formulations remained in acceptable viscosity ranges even after 4 weeks, at room temperature. Viscosities shown in Tables 5 and 6 were measured using a Brookfield Viscometer with a No. 2 spindle at 10 RPM. All viscosities are in cP.

TABLE 5

VISCOSITY AND % NAOCL FOUND AT 1 MONTH RT AND 100° F. FOR 4.3% NAOCL RSM

| SAMPLE # | Viscosity(cP) RT 0 | RT 4 WKS | 100 0 | 100 4 WKS | % $NaOCL_{RT}$ 0 | % $NaOCL_{RT}$ 4 WKS | % $NaOCL_{100}$ 0 | % $NaOCL_{100}$ 4 WKS |
|---|---|---|---|---|---|---|---|---|
| 1 | 5 | 5 | 5 | 5 | 4.3 | 3.6 | 4.3 | 3.4 |
| 2 | 5 | 5 | 5 | 5 | 4.3 | 3.4 | 4.3 | 3.3 |
| 3 | 215 | 175 | 195 | 80 | 4.3 | 3.4 | 4.3 | 3.1 |
| 4 | 850 | 775 | 845 | 240 | 4.3 | 3.6 | 4.3 | 3.2 |
| 5 | 15 | 20 | 15 | 10 | 4.3 | 3.4 | 4.3 | 3.2 |
| 6 | 45 | 5 | 45 | 5 | 4.3 | 3.6 | 4.3 | 3.3 |
| 7 | 30 | 25 | 30 | 10 | 4.3 | 3.6 | 4.3 | 3.3 |
| 8 | 140 | 75 | 140 | 30 | 4.3 | 3.4 | 4.3 | 3.1 |
| 9 | 5 | 5 | 5 | 5 | 4.3 | 3.5 | 4.3 | 3.3 |
| 10 | 65 | 100 | 70 | 50 | 4.3 | 3.6 | 4.3 | 3.3 |
| 11 | 5 | 5 | 5 | 5 | 4.3 | 3.6 | 4.3 | 3.3 |
| 12 | 850 | 855 | 850 | 400 | 4.3 | 3.6 | 4.3 | 3.3 |
| 13 | 190 | 130 | 185 | 40 | 4.3 | 3.6 | 4.3 | 3.2 |
| 14 | 170 | 170 | 220 | 40 | 4.3 | 3.5 | 4.3 | 3.1 |
| 15 | 165 | 110 | 195 | 40 | 4.3 | 3.6 | 4.3 | 3.2 |

RSM EXPERIMENTAL DESIGN

Factor Ranges

PRIMACOR 5980: 0.10–0.25%
AMMONYX MO: 0.50–2.00%
HAMPOSYL L-95: 0.20–1.00%

TABLE 6

VISCOSITY AND % NAOCL FOUND AT 1 MONTH RT AND 100° F. FOR 2.5% NAOCL RSM

| SAMPLE # | Viscosity(cP) RT 0 | RT 4 WKS | 100 0 | 100 4 WKS | % $NaOCL_{RT}$ 0 | % $NaOCL_{RT}$ 4 WKS | % $NaOCL_{100}$ 0 | % $NaOCL_{100}$ 4 WKS |
|---|---|---|---|---|---|---|---|---|
| 1 | 5 | 5 | 5 | 5 | 2.5 | 2.3 | 2.5 | 2.1 |
| 2 | 5 | 5 | 5 | 5 | 2.5 | 2.1 | 2.5 | 2.0 |
| 3 | 160 | 180 | 155 | 80 | 2.5 | 2.2 | 2.5 | 2.0 |
| 4 | 935 | 680 | 980 | 450 | 2.5 | 2.2 | 2.5 | 1.9 |
| 5 | 15 | 20 | 15 | 5 | 2.5 | 2.1 | 2.5 | 2.0 |
| 6 | 15 | 5 | 15 | 5 | 2.5 | 2.1 | 2.5 | 2.0 |
| 7 | 70 | 70 | 70 | 30 | 2.5 | 2.1 | 2.5 | 2.1 |
| 8 | 330 | 300 | 340 | 125 | 2.5 | 2.2 | 2.5 | 1.9 |
| 9 | 5 | 5 | 5 | 5 | 2.5 | 2.2 | 2.5 | 2.1 |
| 10 | 40 | 55 | 55 | 20 | 2.5 | 2.1 | 2.5 | 2.0 |
| 11 | 5 | 5 | 5 | 5 | 2.5 | 2.3 | 2.5 | 1.9 |
| 12 | 690 | 665 | 620 | 250 | 2.5 | 2.2 | 2.5 | 2.1 |
| 13 | 280 | 250 | 260 | 75 | 2.5 | 2.1 | 2.5 | 2.0 |
| 14 | 210 | 360 | 260 | 80 | 2.5 | 2.2 | 2.5 | 1.9 |
| 15 | 265 | 235 | 260 | 75 | 2.5 | 2.2 | 2.5 | 1.9 |

RSM EXPERIMENTAL DESIGN

Factor Ranges

PRIMACOR 5980: 0.10–0.25%
AMMONYX MO: 0.20–2.00%
HAMPOSYL L-95: 0.20–1.00%
PLUS 5% NaCl ADDED

Table 7 shows the effect of variations in shear on viscosity of the present composition. Various formulations were tested, using a Brookfield viscometer and a Number 2 spindle at 10 rpm and 100 rpm. It can be seen that the higher shear force did not significantly affect viscosity.

TABLE 7

| % Ammonyx MO | % Hamposyl-L | % Primacor 5980 | % NaOCL | % NaOH | Viscosity 10 rpm | Viscosity 100 rpm |
|---|---|---|---|---|---|---|
| 1.6 | 0.20 | .12 | 4.4 | 1.8 | 216 | 262 |
| 1.6 | 0.23 | .15 | 4.3 | 1.8 | 352 | 375 |
| 1.6 | 0.20 | .03 | 5.6 | 2.1 | 266 | 255 |
| 1.6 | 0.24 | .03 | 5.8 | 1.7 | 180 | 204 |

TABLE 7-continued

| % Ammonyx | | % Primacor | | | Viscosity | |
|---|---|---|---|---|---|---|
| MO | % Hamposyl-L | 5980 | % NaOCL | % NaOH | 10 rpm | 100 rpm |
| 1.6 | 0.27 | .03 | 5.8 | 1.4 | 172 | 202 |

Viscosity measured in cP using a Brookfield Viscometer and Number Two spindle at room temperature(20°)

The compositions of Tables 1, 4, 5, 6 and 7, and of FIGS. 1–6 contain the indicated components, with the balance water. All compositions were formulated by adding a 10% Primacor dispersion (as previously described) to water, and mixing in the desired amounts of Ammonyx and Hamposyl (as 30% aqueous solutions). This mixture was stirred well and bleach (as Clorox liquid bleach) was slowly added. Desired levels of NaOH and/or NaCl were admixed with the bleach. A clear solution resulted, and the NaOCl concentration was verified by titration.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

We claim:

1. A thickened pourable aqueous bleach composition comprising (a) a bleaching-effective amount of an active halogen compound;

(b) a thickening effective amount of a soluble polymeric thickener having a weight average molecular weight of between about one thousand and one hundred thousand, the polymeric thickener comprising a charged comonomer and an uncharged comonomer in proportions such that the resultant polymer has an acid number, in its acid form, of between about 80–400 mg KOH/g polymer, the polymeric thickener being soluble in a surfactant system; and (c) a surfactant system including a bleach-resistant uncharged surfactant and a bleach-resistant anionic surfactant, the surfactant system being present in an amount sufficient to solubilize the polymeric thickener; and wherein the polymeric thickener, halogen compound and surfactant system comprise a solution substantially free of undissolved solids.

2. The composition of claim 1 of wherein the active halogen compound is selected from the group consisting of the alkali metal and alkaline earth salts of hypohalite, haloamines, haloamides and haloimides.

3. The composition of claim 1 wherein said charged comonomer is selected from the group consisting of acrylic acid, methacrylic acid, carboxylated styrene, sulfonated styrene, ethylene sulfonic acid, alkene carboxylic acid, maleic acid and half esters thereof, and mixtures thereof; and said uncharged comonomer is selected from the group consisting of ethylene, propylene, butadiene, styrene, esters, and mixtures thereof.

4. The composition of claim 3, wherein the uncharged surfactant is selected from the group consisting of amine oxides, betaines, and mixtures thereof; and the anionic surfactant is selected from the group consisting of acyl sarcosinates, alkyl taurides, alkyl sulfates, alkyl ether sulfates, alkyl ether carboxylates, alkyl diphenyloxide sulfonates, soaps and mixtures thereof.

5. The composition of claim 1 wherein the charged comonomer is acrylic acid and the uncharged comonomer is ethylene;

the uncharged surfactant is an amine oxide and the charged surfactant is an amidocarboxylate; and a ratio of polymeric thickener to surfactant system is between about 1:5 and 1:30.

6. The composition of claim 5 wherein a mole ratio of amine oxide of the uncharged surfactant to a carboxylate functionality of said polymeric thickener is between about seven to one to one hundred and twenty to one.

7. The composition of claim 5 wherein the amine oxide is an alkyl dimethyl amine oxide having an alkyl group of from eight to eighteen carbons in length; and the amidocarboxylate is an alkali metal sarcosinate having an acyl group of from eight to eighteen carbons in length.

8. The composition of claim 7 wherein the viscosity of the composition is at least 100 centipoise.

9. The composition of claim 5 wherein the composition ionic strength is between about 0.5 and 5.0 molal.

10. The composition of claim 1 wherein the halogen bleach is present in an amount of about 0.2% to 15%, the polymeric thickener is present in an amount of about 0.1% to 1.0%, the uncharged surfactant is present in an amount of about 0.5% to 3.0% and the anionic surfactant is present in an amount of about 0.1% to 2.0%, all based on weight of the composition.

11. The composition of claim 10 and further including about 0.5% to 5% sodium chloride and about 0.25% to 4% sodium hydroxide.

12. The composition of claim 1 wherein the charged comonomer comprises about 20–75 mole percent, and the uncharged comonomer about 80–25 mole percent, of the polymeric thickener.

13. A method for preparing a thickened aqueous bleaching composition in steps comprising (a) preparing an aqueous dispersion of a soluble polymeric thickener having a weight average molecular weight of between about one thousand and one hundred thousand, the polymeric thickener comprising a charged comonomer and an uncharged comonomer in proportions such that the resultant polymer has an acid number, in its acid form, of between about 80–400 mg KOH/g polymer, the polymeric thickener being soluble in a surfactant system and present in a thickening effective amount, the dispersion further including sufficient of a base to neutralize the polymeric thickener;

(b) preparing an aqueous solution of between about 0.2% to 15% of a halogen bleach;

(c) adding the dispersion of part (a) to sufficient of a quantity of water to result in about 0.1% to 1.0% polymeric thickener, adding thereto a solubilizing effective amount of surfactant system comprising about 0.1% to 2.0% of an anionic surfactant and about 0.5% to 3.0% of an uncharged surfactant, and mixing the resulting solution; and (d) mixing the solution of (b) with the solution of (c) and with about 0.25% to 4.0% sodium hydroxide; and wherein the polymeric thickener, bleach and surfactant system comprise a solution substantially free of undissolved solids.

14. The method of claim 13 wherein said charged comonomer is selected from the group consisting of acrylic acid, methacrylic acid, carboxylated styrene, sulfonated styrene, ethylene sulfonic acid, alkene carboxylic acid, maleic acid and half esters thereof, and mixtures thereof;

said uncharged comonomer is selected from the group consisting of ethylene, propylene, butadiene, styrene, esters, and mixtures thereof;

the uncharged surfactant is selected from the group consisting of amine oxides, betaines, and mixtures thereof; and the anionic surfactant is selected from the group consisting of acyl sarcosinates, alkyl taurides, alkyl sulfates, alkyl ether sulfates, alkyl ether carboxylates, alkyl diphenyloxide sulfonates, soaps and mixtures thereof.

15. The method of claim 13 wherein said charged comonomer is acrylic acid and said uncharged comonomer is ethylene;

the uncharged surfactant is an amine oxide and the charged surfactant is an amidocarboxylate; and a ratio of the polymeric thickener to the surfactant system is between about 1:5 and 1:30.

16. The method of claim 13 wherein the charged comonomer comprises about 20–75 mole percent, and the uncharged comonomer about 80–75 mole percent, of the polymeric thickener.

17. A method for cleaning a non-horizontal surface comprising (a) contacting a non-horizontal surface having a stain thereon with a thickened cleanser comprising a bleaching-effective amount of a halogen bleach, a thickening effective amount of a soluble polymeric thickener, and a surfactant system, the polymeric thickener comprising a charged comonomer, and an uncharged comonomer in proportions such the resultant polymer has an acid number, in its acid form, of between about 80–400 mg KOH/g polymer, the polymeric thickener having a weight average molecular weight of between about one thousand and one hundred thousand, the surfactant system being present in an amount sufficient to solubilize the polymeric thickener, and including an uncharged surfactant and an anionic surfactant, a ratio of the surfactant system to the polymeric thickener being between about 5:1 and 30:1; and wherein the polymeric thickener, bleach and surfactant system comprise a solution substantially free of undissolved solids;

(b) allowing the cleanser to reside on the surface for a cleaning-effective time; and (c) removing the cleanser and stain.

18. The method of claim 17 wherein said charged comonomer is selected from the group consisting of acrylic acid, methacrylic acid, carboxylated styrene, sulfonated styrene, ethylene sulfonic acid, alkene carboxylic acid, maleic acid and half esters thereof, and mixtures thereof;

said uncharged comonomer is selected from the group consisting of ethylene, propylene, butadiene, styrene, esters, and mixtures thereof;

the uncharged surfactant is selected from the group consisting of amine oxides, betaines, and mixtures thereof; and the anionic surfactant is selected from the group consisting of acyl sarcosinates, alkyl taurides, alkyl sulfates, alkyl ether sulfates, alkyl ether carboxylates, alkyl diphenyloxide sulfonates, soaps and mixtures thereof.

19. The method of claim 17 wherein said charged comonomer is acrylic acid and said uncharged comonomer is ethylene;

the uncharged surfactant is an amine oxide and the charged surfactant is an amidocarboxylate; and a ratio of polymer thickener to surfactant system is between about 1:5 and 1:30.

20. The method of claim 17 wherein the charged comonomer comprises about 20–75 mole percent, and the uncharged comonomer about 80–75 mole percent, of the polymeric thickener.

21. A thickened pourable aqueous bleach composition comprising (a) a bleaching-effective amount of an active halogen compound;

(b) a thickening-effective amount of a soluble polymeric thickener having a weight average molecular weight of between about three thousand and one hundred thousand, and comprising a charged comonomer selected from the group consisting of acrylic acid, methacrylic acid, carboxylated styrene, sulfonated styrene, ethylene sulfonic acid, alkene carboxylic acid, maleic acid and half-esters thereof, and mixtures thereof, and an uncharged comonomer, selected from the group consisting of ethylene, propylene, butadiene, styrene, esters, and mixtures thereof, the charged and uncharged comonomers being in present in a proportion such that the resultant polymer has an acid number, in its acid form, of between about 80–400 mg KOH/g polymer the polymeric thickener being soluble in a surfactant system; and (c) a surfactant system including a bleach resistant uncharged surfactant, selected from the group consisting of amine oxides, betaines, and mixtures thereof, and a bleach resistant anionic surfactant, selected from the group consisting of acyl sarcosinates, alkyl taurides, alkyl sulfates, alkyl ether sulfates, alkyl ether carboxylates, alkyl diphenyloxide sulfonates, soaps and mixtures thereof, the surfactant system being present in an amount sufficient to solubilize the polymeric thickener; and wherein the polymeric thickener, halogen compound and surfactant system comprise a solution substantially free of undissolved solids.

22. The composition of claim 21 wherein said charged comonomer is acrylic acid and said uncharged comonomer is ethylene;

the uncharged surfactant is an amine oxide and the charged surfactant is an amidocarboxylate; and a ratio of polymeric thickener to surfactant system is between about 1:5 and 1:30.

23. The composition of claim 21 wherein the charged comonomer comprises about 20–75 mole percent, and the uncharged comonomer about 80–75 mole percent, of the polymeric thickener.

* * * * *